US010086255B2

(12) United States Patent
Puget et al.

(10) Patent No.: US 10,086,255 B2
(45) Date of Patent: Oct. 2, 2018

(54) GLIDING BOARD

(71) Applicant: Skis Rossignol, Saint-Jean-de-Moirans (FR)

(72) Inventors: Nicolas Puget, Novalaise (FR); Johan Vailli, Coublevie (FR)

(73) Assignee: SKIS ROSSIGNOL, Saint-Jean-de-Moirans (FR)

( * ) Notice: Subject to any disclaimer, the term of this patent is extended or adjusted under 35 U.S.C. 154(b) by 20 days.

(21) Appl. No.: 15/183,140

(22) Filed: Jun. 15, 2016

(65) Prior Publication Data

US 2016/0361622 A1 Dec. 15, 2016

(30) Foreign Application Priority Data

Jun. 15, 2015 (FR) ..... 15 55441

(51) Int. Cl.

| | |
|---|---|
| ***A63C 7/08*** | (2006.01) |
| ***A63C 5/048*** | (2006.01) |
| ***A63C 5/02*** | (2006.01) |
| ***A63C 5/04*** | (2006.01) |
| ***A63C 7/06*** | (2006.01) |

(52) U.S. Cl.

CPC ..... *A63C 7/08* (2013.01); *A63C 5/02* (2013.01); *A63C 5/048* (2013.01); *A63C 5/0434* (2013.01); *A63C 7/06* (2013.01)

(58) Field of Classification Search

None

See application file for complete search history.

(56) References Cited

U.S. PATENT DOCUMENTS

| | | | | |
|---|---|---|---|---|
| 3,063,728 | A * | 11/1962 | Patterson | A63C 5/0485 280/608 |
| 4,178,012 | A * | 12/1979 | Roth | A63C 5/0428 280/604 |
| 4,334,369 | A | 6/1982 | Brunel | |
| 6,659,492 | B2 * | 12/2003 | Gousie | A63C 5/00 280/604 |
| 8,596,667 | B1 * | 12/2013 | Colaianni | A63C 5/006 280/609 |
| 8,925,956 | B1 | 1/2015 | Harkin | |
| 2003/0101622 | A1 | 6/2003 | Darnell | |
| 2006/0091645 | A1 | 5/2006 | Cobb et al. | |
| 2007/0114779 | A1 * | 5/2007 | Ametsbichler | A63C 7/02 280/809 |
| 2011/0079986 | A1 | 4/2011 | Gradman et al. | |

FOREIGN PATENT DOCUMENTS

| | | |
|---|---|---|
| EP | 0 026 148 A | 4/1981 |

OTHER PUBLICATIONS

Search report and written opinion issued by French Patent Office for priority application FR 1555441, dated Apr. 13, 2016.

* cited by examiner

*Primary Examiner* — James A Shriver, II
*Assistant Examiner* — Hilary L Johns
(74) *Attorney, Agent, or Firm* — Haug Partners LLP

(57) ABSTRACT

The present invention relates to a gliding board for cross-country skiing, intended to receive a shoe fastener (F) including an upper face, a lower face and side ridges, characterized in that at least one of the side ridges of the board is provided with a series of notches (11) whereof each rim (11*a*) defines, on the one hand, a transverse stop face (12) making it possible to stop the board in the backwards direction, and on the other hand, a longitudinal connecting face (13) between the notches (11) allowing forward gliding.

18 Claims, 7 Drawing Sheets

GLIDING BOARD

The present invention relates to a gliding board for cross-country skiing.

The invention more particularly relates to a board making it possible both to travel upward and downward on snowy terrain and to engage in cross-country skiing.

Snowshoe boards exist allowing safe walking, on snowy terrain, upward and downward.

These boards, which are generally very short, have a shoe fastener in a central part optionally surrounded by open zones and bearing in and/or on the snow to stabilize the movement on the snow.

However, these boards do not allow any downward gliding, which makes walks long and tiring.

Furthermore, cross-country skis are known made up of boards comprising a sandwich-type structure with a core and reinforcements, side rims provided with edges and a sole plate.

For upward movement, the sole plate is provided with a backstop strip called "climbing skin" that prevents the board from returning backward.

For downward movement, the climbing skins mounted on each of the skis are removed to allow the ski to glide on the snow.

Such skis are difficult to handle and require a sufficient level of technical ski knowledge.

Furthermore, they are tedious to use due to the need to assemble or disassemble the climbing skins below the ski to go from upward to downward travel.

Document U.S. Pat. No. 8,925,956 describes a gliding vehicle made up of a lower hull provided with backstop teeth.

However, the profile and position of these teeth do not make it possible to retain the board toward the rear when the board moves in the climbing phase.

Indeed, the chosen shape of the teeth, which is asymmetrical, slows the gliding of the ski in the forward direction and has no backstop effect toward the rear.

Furthermore, the hull does not allow stable movement, primarily upward.

Document US 20060091645A1 describes a board whereof the side rims are provided with corrugations.

The profile of these corrugations is designed to locally increase the catching of the board on the snow during turns during the descent and not to prevent the backward movement of the board so as to secure the ascent of the cross-country skier.

Indeed, these corrugations are symmetrical and favor gliding of the board both forward and backward.

The present invention aims to resolve these technical problems ergonomically by proposing a compact, versatile gliding board that is easy to use for mountain skiing and allows good retention on the snow during the ascent phase while retaining gliding capacities for the descent, irrespective of the type of snow and the declination of the journey.

Another aim of the invention is to propose a board having a simple structure not including edges, unlike traditional skis.

This aim is achieved, according to the invention, using a board characterized in that at least one of the side ridges of the board is provided with a series of notches whereof the rims define, on the one hand, transverse stop faces making it possible to stop the board in the backwards direction, and on the other hand, longitudinal connecting faces between the notches.

According to one advantageous feature, each of its two side ridges are provided with a series of notches extending over at least part of the zone of the board intended to receive the user's shoe.

According to a first alternative embodiment, the rims are vertical.

According to another feature, it is provided that on each side ridge of the board, the intersections of the rims of the series of indentations with the lower face are positioned on a same concave curve.

According to still another feature, the longitudinal connecting faces between the adjacent notches of a same series are beveled toward the inside of the board.

According to one particular feature, it is provided that at each notch, the transverse face and the longitudinal face are not symmetrical relative to the transverse axis of the board passing through the rim of that notch.

According to still another feature, the longitudinal connecting faces have an angle comprised between 60° and 85° relative to the transverse axis of the board passing through their rim.

Furthermore, the transverse stop faces have an angle comprised between 0° and 15° on either side of the transverse axis of the board passing through their rim.

Preferably, at each of the rims, the transverse stop face has an angle of 90° with the longitudinal connecting face.

According to one dimensional feature, the notches have a depth comprised between 2 and 10 mm, while the apices of two consecutive rims are spaced apart by at least 20 mm, and preferably by at least 30 mm.

In parallel, the notches extend over a height greater than or equal to half the thickness of the lateral ridge of the board, and on the lateral ridge, over at least 300 mm while being centered on the positioning of the middle of the shoe.

According to another alternative, the board is made up of a core positioned between the upper and lower faces and the lower face may be provided with a sole plate extending from one lateral ridge to the other.

Preferably, this core comprises partially hollowed out zones.

Advantageously, the sole plate extends to the side ridges of the board where the series of notches is formed.

According to still another aspect of the invention, the lower face of the board is provided with at least one longitudinal slot intended to receive a backstop skin.

Alternatively or additionally, the lower face of the board is provided with scales.

The board according to the invention allows cross-country skiing on a wide variety of snowy terrains, in particular more or less hilly terrain, and on different types of snow, for example hard, transformed or powder snow.

With the board according to the invention, which does away with traditional edges, the skier may advance easily on the ascent.

The fastener used allows him to leave the heel of his shoe free, both without any risk of moving backwards on flat terrain and slopes and with limited burying in the snow.

He may next descend without any modification of the board by gliding in a safe and controlled manner owing to the lateral catching of the notches in the snow, primarily useful during turns.

For the descent phase, the fastener used may allow rotational freedom of the free heel of the shoe or lock it.

The invention will be better understood upon reading the following description, accompanied by drawings explained below.

Figure 1:
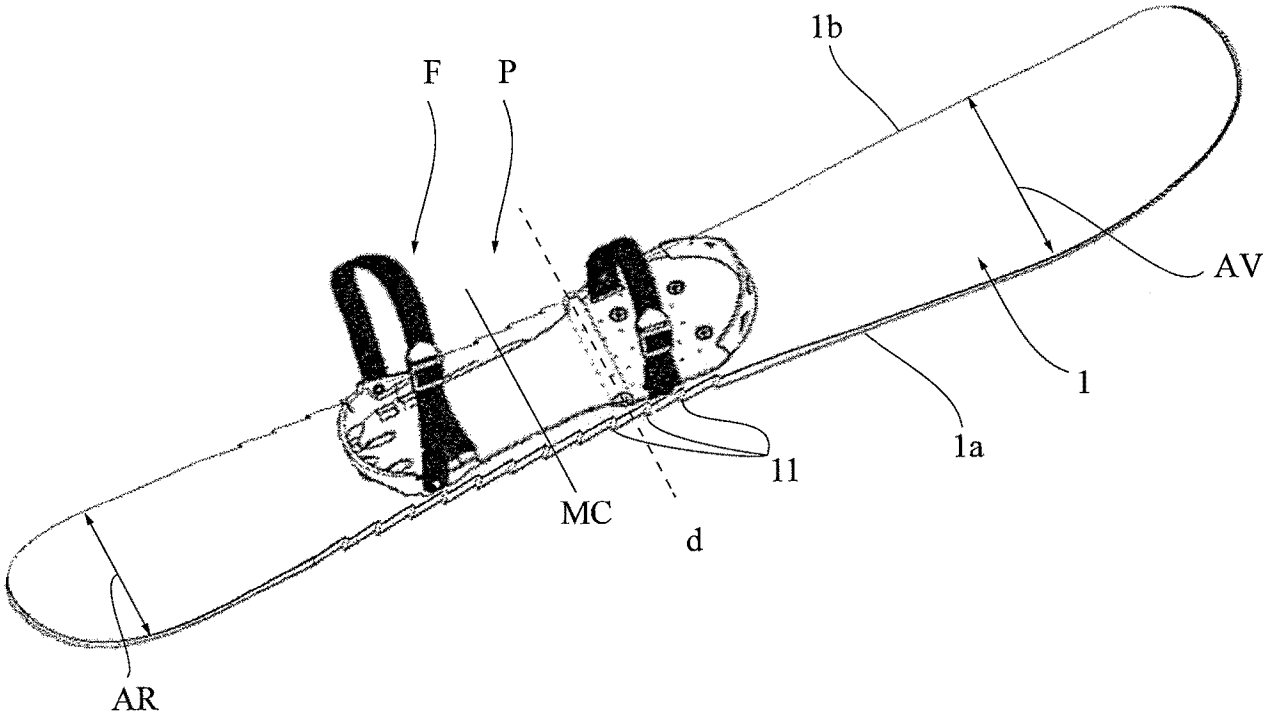
FIG. 1 is a perspective view of one embodiment of the gliding board according to the invention.

The board 1 shown in FIG. 1 is more particularly intended for cross-country skiing and makes it possible to move both upward and downward.

This board is equipped here with a traditional fastener F with a base articulated around an axis d to hold a shoe (not shown). The holding of the shoe is done here by two straps, but any other means of the prior art could be used.

The board 1 has an outer enclosure defined by an upper face, a lower face and side ridges.

In one alternative that will be described later, the lower face is optionally provided with a sole plate S.

The board also includes a sidecut defined by the ridge of the lower face and an arched zone, according to standard ISO 6289.

The longitudinal axis XX' of the board 1 extends from the back to the front of the board and forms the axis of symmetry of the board 1. The transverse axis YY' of the board 1 is perpendicular to the longitudinal axis XX' of the board 1.

Figure 3A:
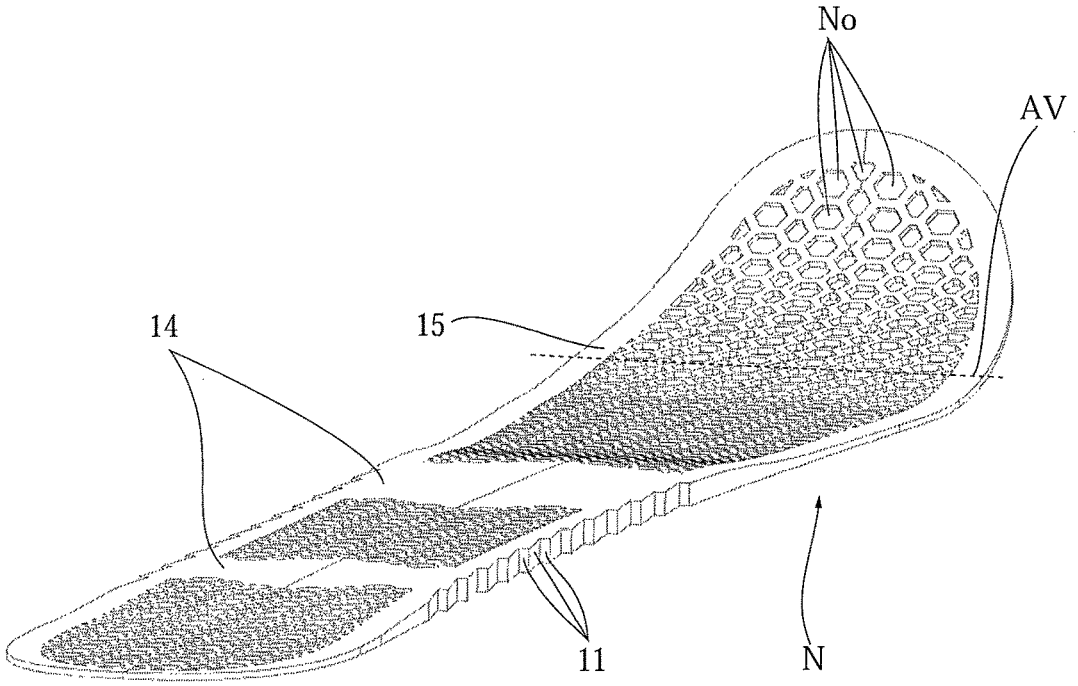
FIGS. 3A and 3B are perspective and top views, respectively, of one embodiment of the core of the board according to the invention.
Figure 3B:
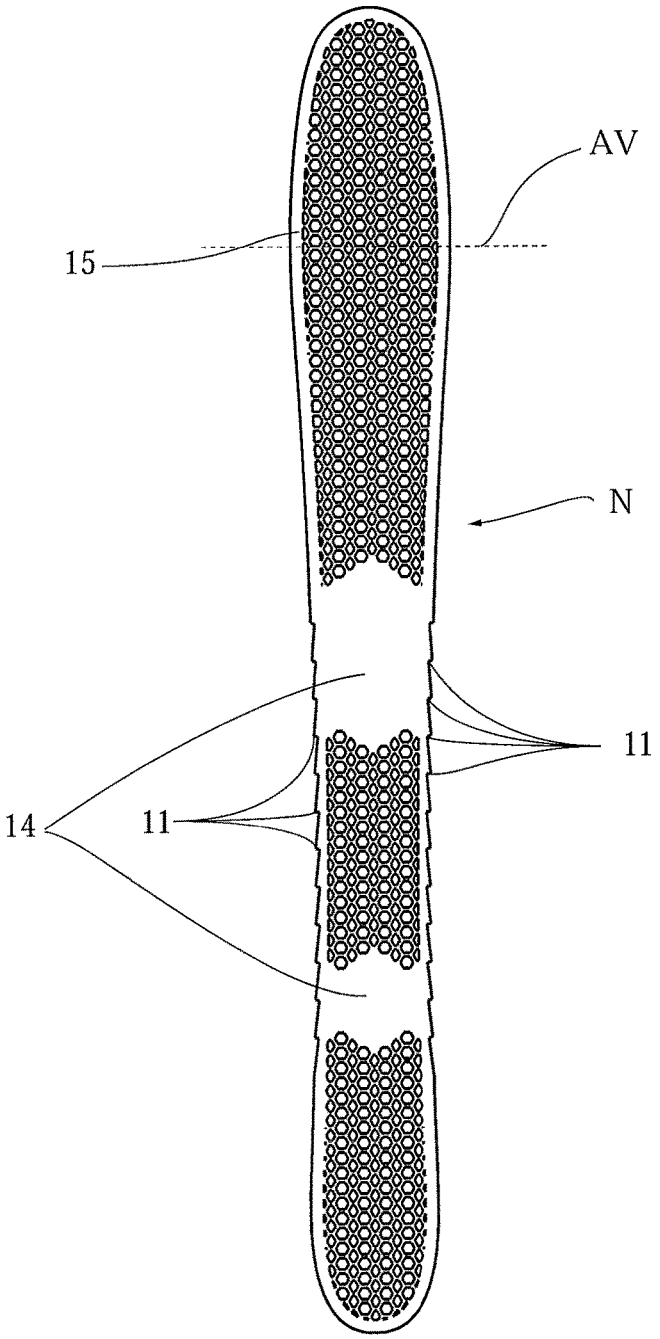

According to the alternative of FIGS. 3A and 3B, the board 1 has a structure made up of a core N (shown in detail in FIG. 3A), generally made from wood or plastic, for example polyurethane foam or ABS.

Figure 4A:
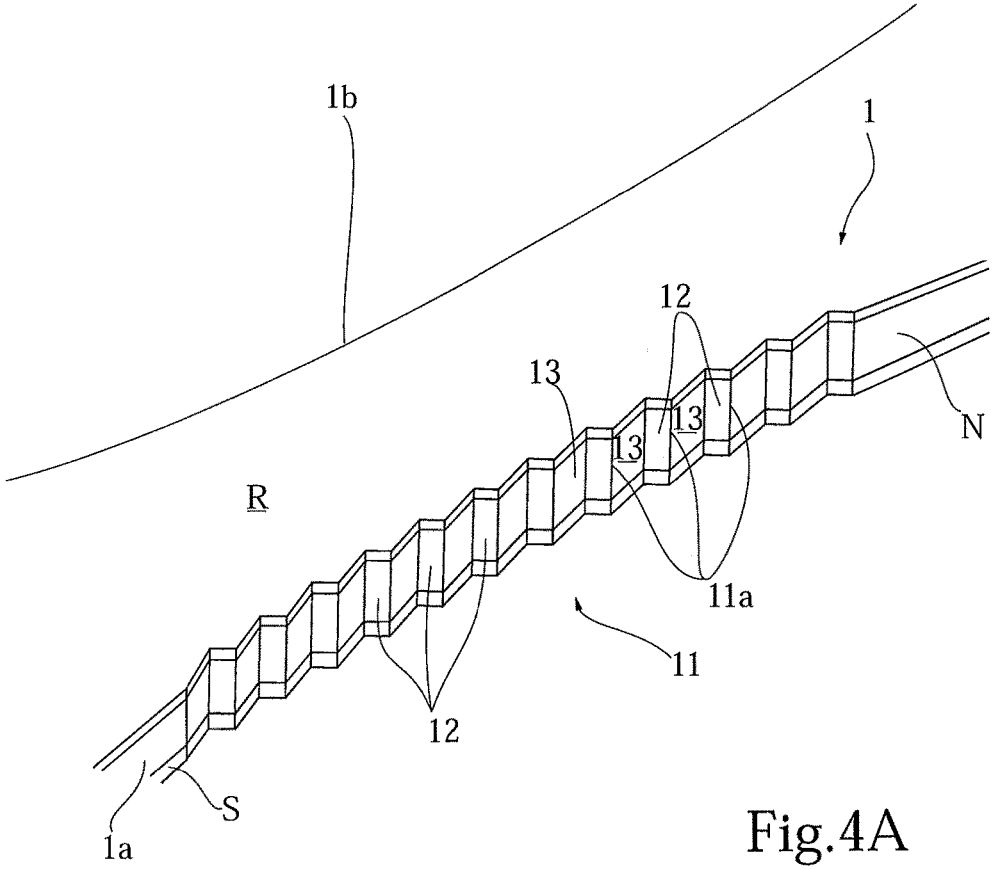
FIGS. 4A, 4B are detailed perspective views, respectively, of the rim of the finished board, and the core according to the invention.
Figure 5:
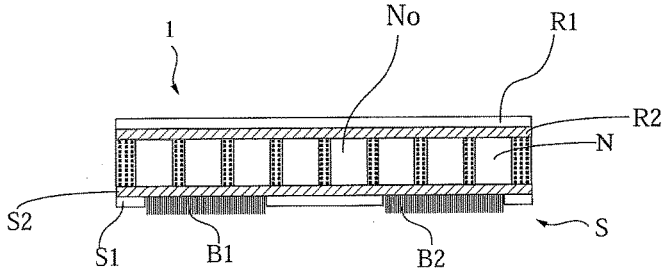
FIG. 5 is a cross-sectional view of one alternative of the board according to the invention.

As illustrated by FIGS. 4A and 5, this core is provided with at least one upper layer formed from a protective covering R1 made from a plastic, thermoplastic or polymer material forming the upper face of the board and/or at least one reinforcing layer R2 made from a composite material such as glass and/or carbon and/or Kevlar fibers or from a metal material, two side rims 1*a*, 1*b* and at least one lower layer formed by a sole plate S1 associated with at least one other reinforcing layer S2 made from a composite or metal material, for example.

This board has a curved sidecut, which more specifically has a concave radius so as to have a maximum width AV in the front part of the board and a maximum width AR in the rear part of the board.

The narrowest zone of the board is situated at the ski waist P.

This board is, according to the invention, completely free of edges. The sole plate S therefore extends over the entire width of the board and forms its lower side ridges.

The invention consists of producing, on at least one of the side ridges of the board 1 (and in the illustrated example, on both ridges), a series of notches 11 on the one hand seeing to the axial catching of the board in the snow, in particular when the ski is slanted, in the descent and ascent phases, and on the other hand, performing a backstop function in the ascent phase.

More specifically, the notches 11 create lateral overpressure zones when the board is tilted on its side rim to perform a turn or when the skier hugs the slope in the ascent phase. It should be emphasized that the fewer notches there are in the series, the greater the catching force is on each notch, which leads to limiting the number of notches.

The series of notches 11 extends over at least part of the zone of the board intended to receive the shoe.

These notches are made either directly and integrally on the side faces of the assembly formed by the core N (see FIGS. 3A and 3B) covered with the lower and upper layers, or (according to an alternative that is not shown) on a profile attached and fastened on the side ridge or rim la, lb of the board or core.

Preferably, the notches 11 are all identical.

However, it would be possible, according to the invention, to vary the profile and geometry of the different notches in the series, depending on their position on the board.

As illustrated by the figures, each notch 11 has a vertical rim 11*a* defining, toward the rear of the board, a transverse face 12 that is parallel or slightly inclined toward the back of the ski relative to its transverse axis YY' and, toward the front of the board, a longitudinal face 13 that is slightly inclined relative to its longitudinal axis XX' and recessed toward this longitudinal axis XX'.

In other words, the transverse face 12 extends from the rear side of the rim 11*a*, while the longitudinal face 13 extends from the front side of the rim 11*a*, relative to the front of the board.

The transverse faces 12 of the series of notches 11 make it possible to perform a stop or blocking function of the ski toward the rear, preventing the latter from moving backwards during the ascent phase when the board sinks into the snow or when the board is inclined relative to the surface of the snow and slanted on one of its lateral ridges.

The longitudinal connecting faces 13 allow gliding of the ski in the forward direction without retaining. The rims lla are vertical, but they could have a certain incline relative to the vertical without going beyond the scope of the invention.

It is provided, as an example embodiment, for each series of notches to comprise between 6 and 12 notches over a length comprised between 300 and 350 mm for a board with a length comprised between 0.8 and 1.25 m and distributed uniformly over that zone.

The zone of the notches is preferably not centered relative to the ends of the board, but centered relative to the positioning point of the middle of the shoe MC on the board.

If the series comprises six notches distributed uniformly, the spacing between the two rims of two consecutive notches is from 28 to 32 mm, and preferably 30 mm, while for a series of twelve notches, this spacing is from 58 to 62 mm, and preferably 60 mm.

The zone of the notches 11 could be more extensive, at most extending between the front AV and rear AR maximum width lines, or even over a more restricted length comprised between 300 and 600 mm.

For a notched zone with a length equal to 600 mm, the number of notches would then be comprised between 12 and 20 notches.

In one alternative that is not shown, the distribution of these notches over the length of the board may not be uniform. Thus, this distribution may be irregular or gradually tighter and/or more compact from front to rear. This distribution may also, on each edge of the board, assume the form of two separate zones on which the notches are distributed regularly and uniformly; these two zones being situated respectively in the zone of the board intended to receive the front of the shoe and the zone of the board intended to receive the back of the shoe with a spacing greater than 100 mm between these two zones.

It would also be possible to provide that the notched zones of each side ridge of the board be offset over the axis XX' and not situated opposite one another.

In general, the spacing between the lower end of the respective rims of two adjacent notches is greater than 20 mm, and preferably greater than 30 mm.

Regarding the dimensions of the board, the width at the ski waist is for example comprised between 75 and 95 mm, and is preferably 90 mm, the maximum nose width is comprised between 110 mm and 130 mm, and is preferably 120 mm, while the maximum heel width is comprised between 90 mm and 110 mm, and is preferably 100 mm.

The maximum thickness of the finished rim of the board is comprised between 6 and 15 mm, and is preferably between 8 and 10 mm.

Furthermore, the board has an upwardly raised segment in its nose part.

In the rear part of the board, the heel may be raised upwardly, but also may not have a raised part. In this last configuration, the rear part of the heel is therefore flat to avoid instabilities when the skier's weight bears excessively toward the rear.

To obtain a difference in behavior of the board between a gliding phase toward the rear in the backwards direction and gliding phase toward the front in the movement direction, the transverse face 12 of the notch 11 and the longitudinal face of the notch 11 are not symmetrical relative to the transverse axis YY' passing through the rim 11*a*. In particular, the angle α defined between the longitudinal connecting face 13 and the transverse axis YY' passing through the rim 11*a* is, in absolute value, greater than the angle β defined between the transverse stop face 12 and the same transverse axis YY' passing through the same rim lla.

Consequently, the transverse faces 12 are rectilinear and inclined toward the rear of the board with an angle β comprised between 0° and 15° relative to the transverse axis YY' of the board and passing through the rim 11*a* (see FIG. 4B) to allow blocking of the board toward the rear while therefore forming a stop and a snow jam at this transverse face 12. Preferably, the angle β is approximately 0°.

In the context of the invention, it would be possible to provide, according to an alternative that is not shown, that the transverse and longitudinal faces be curved as long as a transverse face is kept that forms a stop toward the rear to perform the backstop function.

Figure 2:
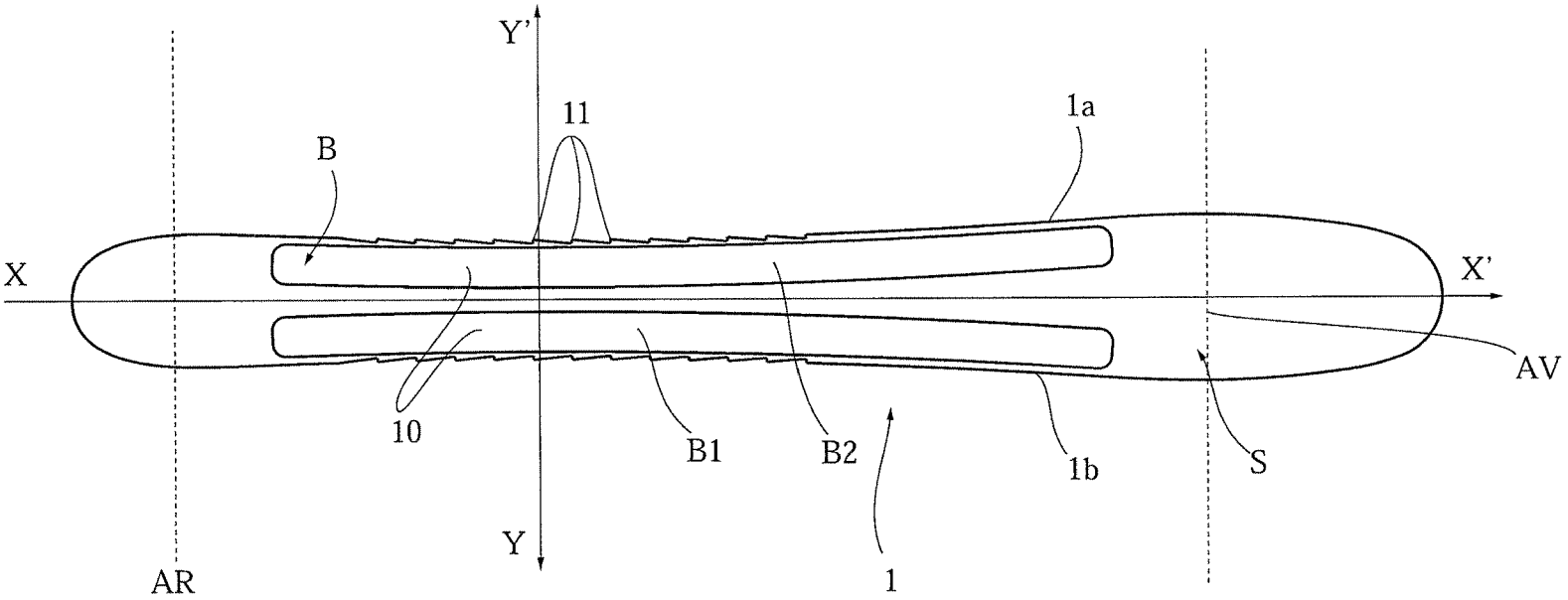
FIG. 2 shows a bottom view of the embodiment of FIG. 1.
Figure 4B:
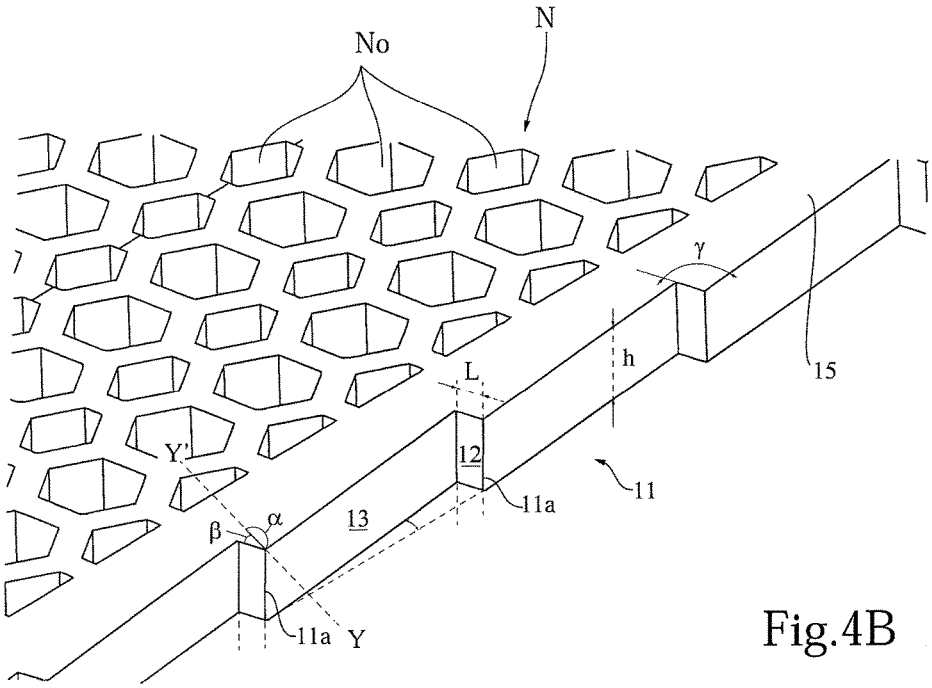

As illustrated in particular by FIGS. 2 and 4A, 4B, on each of the ridges or rims 1*a*, 1*b*, the intersections of the notches or their vertical rims lla with the lower face define a same concave curve that here is combined with the sidecut of the board 1.

To keep this alignment, the longitudinal connecting faces 13 between the adjacent notches 11 are rectilinear and beveled toward the inside of the rim of the board, as illustrated by the detailed view of FIGS. 4A, 4B.

These longitudinal faces 13 are inclined toward the front so as not to hinder the forward travel or gliding of the board and preferably have an angle α comprised between 60 and 85° relative to the transverse axis YY' of the board passing through the rim 11*a* of the notch in question.

In particular, in the illustrated configuration, the angle γ formed between the transverse stop faces 12 and the longitudinal faces 13 is approximately 90° at the rim of a notch 11 so as to offer enough material at the rim and thus increase the strength thereof.

The notches 11 have a depth (corresponding to the width L of the face 12—FIG. 4B) comprised between 2 and 10 mm, preferably between 3 and 5 mm. This depth must indeed not be too shallow so as to allow the transverse face to block enough snow to perform the backwards backstop effect. Thus, fine protuberances with a depth smaller than 1 mm would not make it possible to achieve the aims of the invention.

Furthermore, the notches 11 extend over a height h greater than or equal to half the thickness of the rim la, lb of the board 1.

Preferably, the notches 11 extend over the entire height of the board, in order to obtain a blocking and snow packing surface on the transverse stop face of the notches that is as large as possible. The greater the depth of these notches is, the stronger the backward immobilization effect of the board will be during upward travel, thus even better performing the backstop function via the transverse stop faces.

To lighten the board 1, the core N is partially hollowed out. In the embodiment shown in FIG. 4B, the core N has a cellular honeycomb structure. These cells may be cut from a plastic material such as ABS, for example, or from wood, or molded directly by injecting a plastic material in an appropriate mold, or even be formed directly by a honeycomb material.

However, to avoid weakening the structure of the board in the most stressed zones and to ensure solid anchoring of the fastener on the board, the hollowed out zones NO are preferably situated outside the anchoring or securing zones of the fastener F to the board, as illustrated by FIGS. 3A, 3B. In the illustrated embodiment, the core has two central solid zones 14 as well as a peripheral solid zone 15 to ensure sealing over the perimeter of the board.

More generally, the sole plates are formed from a material gliding on snow of the polyethylene type, and in the context of the invention, the lower face of the board must be equipped with a backstop means limiting the backward gliding properties of the board.

Consequently, this lower face is made up of at least two zones, a gliding zone and a backstop zone. The backstop zone may be made up of a climbing skin or a sole plate provided with scales or any other means known in the prior art.

Figure 6:
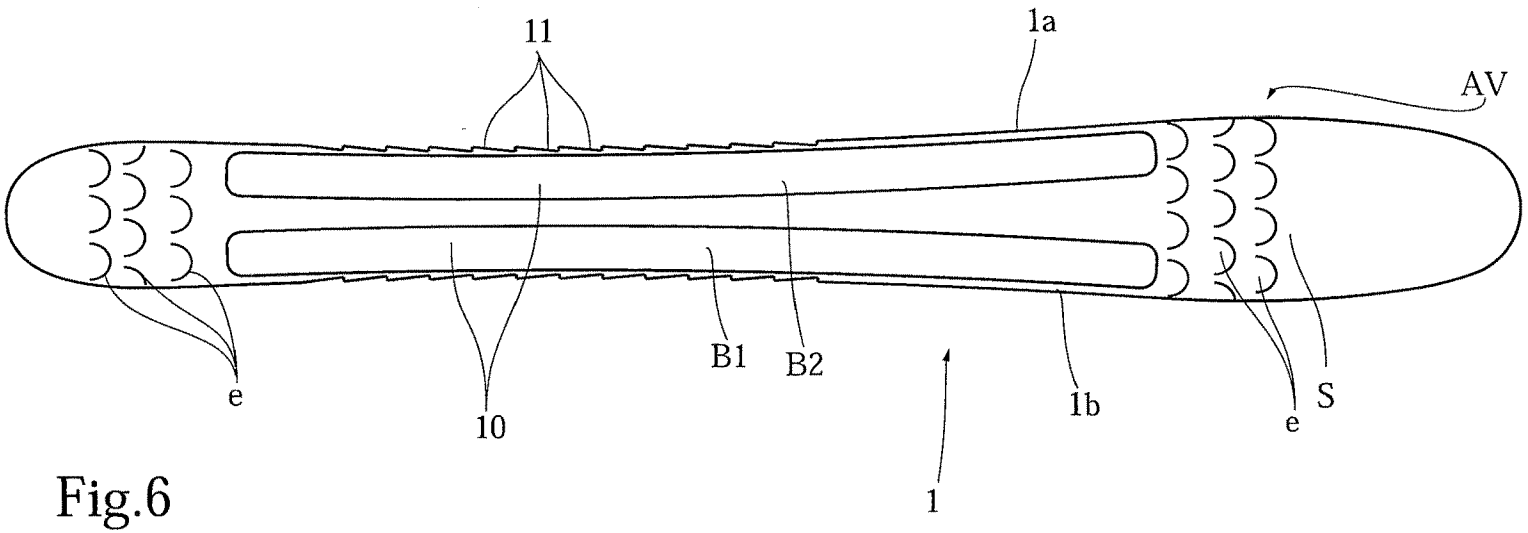
FIG. 6 is a bottom view of one alternative embodiment of the board according to the invention.

In the embodiments of FIGS. 2 and 6, the sole plate S forming the lower face is provided with at least one longitudinal slot 10 intended to receive a strip B of backstop skin of the "climbing skin" type, which may optionally be removable and able to be replaced in case of wear.

In the embodiment of FIG. 2, the sole plate includes two parallel slots 10 for fastening two strips B1, B2.

As illustrated by FIG. 5, preferably, the strips B1, B2 protrude outside the slots 10, beyond the plane of the sole plate S so as to still further limit the descent speed. Of course, to obtain a higher performing board in terms of gliding, and which is therefore faster, the outer surface of the skin may also be positioned at the outer surface of the sole plate S.

Preferably, the strips B have a width of 20 mm and a length of 620 mm and extend, beyond the series of notches 11, for example over a length of 75 mm backward from the last notch situated on the rear side of the board and over a length of 220 mm forward from the last notch situated on the front side of the board.

The strips B may extend over the entire contact length of the board with the snow (ISO 6289 standardized dimension), or preferably, over a length comprised between 70% and 100% of this contact length.

In the transverse dimension of the board, the strip B may cover approximately all of the width of the board while following or not following the profile of the sidecut or keeping rectilinear and parallel ridges.

The backstop zone may also be divided into at least two strips, while leaving gliding zones between these strips.

In another embodiment illustrated in FIG. 6, the zones of the lower face not covered by the strips of climbing skin may be partially provided with scales e that are formed directly from a plastic material and that are oriented such that they prevent the backwards movement of the board.

Still in the embodiment of FIG. 6, the scales are positioned in front of and behind the zone of the strips of climbing skin over a segment extending to the front AV and rear AR maximum width lines. These scales have a rounded shape, but any other shape may be appropriate, such as a triangular shape or a U shape.

The combination of the climbing skin zones with the scale zones makes it possible to optimize the immobilization or braking of the board in a backward sliding movement, irrespective of the type of snow.

Indeed, the climbing skin is more effective on hard snow, while the scales are more effective on flexible snows, i.e., powder or transformed snows.

In another alternative of FIG. 6 (not shown), the portion of the lower face situated between the two strips of skin B1, B2 and/or the portion of the lower face situated between the side ridge of the board and the outer side ridge of the strip of skin, could also includes scales.

The invention also proposes a board including, over the entire contact length, a lower face (which may or may not be provided with a sole plate) made up of a scale zone corresponding to 50% of the contact surface associated with a skin zone corresponding to the other 50%, making it possible to obtain a versatile board in all types of snow.

For more flexible snows, the board will be adapted by choosing a lower face made up of a scale zone covering 70% of the contact surface associated with a skin zone covering 30% of the surface.

Conversely, for harder snows, the board will be adapted by choosing a lower face made up of a scale zone covering 30% of the contact surface associated with a skin zone covering 70% of the surface.

The invention therefore has the advantages of:

offering short boards that are easy to handle and use, that make it possible to climb snowy slopes easily and completely safely, without any risk of gliding backwards, that also allow completely safe gliding on varied slopes in the descent phases, and without it being necessary to perform manipulations or modifications of these boards.

The board according to the invention is also made up of a simplified structure, without edges and with an outer profile suitable for cross-country skiing having a series of backstop notches on the side ridges.

Of course, any inner structure having such an outer profile is comprised in the invention.

In particular, this structure could be manufactured in a single piece from a single traditional material or reinforced by the introduction of fillers or fibers.

The invention claimed is:

1. A gliding board for cross-country skiing intended to receive a shoe fastener, the gliding board comprising:

an upper face, a lower face, and side ridges, wherein at least one of the side ridges of the board is provided with a series of adjacent notches separated by rims, wherein each notch is defined by a front side face forming a transverse face that is configured to stop the board in the backwards direction, and a rear side face forming a longitudinal face configured to allow forward gliding, wherein the front side face and rear side face are asymmetrical relative to a transverse axis of the board.

2. The gliding board according to claim 1, wherein the transverse face of at least one or the notches is inclined toward the transverse axis and toward the rear of the board with an angle between 0° and 15° relative to said transverse axis.

3. The gliding board according to claim 1, wherein the longitudinal face of at least one of the notches has an angle ($\alpha$) between 60° and 85° relative to the transverse axis of the board.

4. The gliding board according to claim 1, wherein the transverse face of each notch has an angle of 90° relative to a corresponding longitudinal face.

5. The gliding board according to claim 1, wherein each of the side ridges of the board is provided with a series of said notches, said notches extending over at least part of a zone of the board configured to receive the shoe faster.

6. The gliding board according to claim 1, wherein the rims are vertical.

7. The gliding board according to claim 1, wherein, on each side ridge, the intersections of the rims with the lower face are positioned on a same concave curve.

8. The gliding board according to claim 1, wherein the longitudinal faces between adjacent notches of a same series are beveled toward an inside of the board.

9. The gliding board according to claim 1, wherein the notches have a depth between 2 and 10 mm.

10. The gliding board according to claim 1, wherein the apices of two consecutive rims are spaced apart by at least 20 mm.

11. The gliding board according to claim 1, wherein the notches extend over a height greater than or equal to half the thickness of the side ridge of the board.

12. The gliding board according to claim 1, wherein the series of notches extend over at least 300 mm of the side ridge and wherein the series of notches are centered on a positioning of the shoe faster.

13. The gliding board according to claim 1, wherein the board is made up of a core positioned between the upper and lower faces and wherein the board further comprises a sole plate on the lower face extending from one lateral ridge to the other.

14. The gliding board according to claim 13, wherein the core comprises partially hollowed out zones.

15. The gliding board according to claim 13, wherein the sole plate extends to the side ridges of the board where the series of notches are formed.

16. The gliding board according to claim 13, wherein said lower face is provided with at least one longitudinal slot intended to receive a backstop skin.

17. The gliding board according to claim 13, wherein said lower face is provided with scales.

18. The gliding board according to claim 1, wherein the apices of two consecutive rims are spaced apart by at least 30 mm.

* * * * *